US006576601B1

(12) United States Patent
Mikic et al.

(10) Patent No.: US 6,576,601 B1
(45) Date of Patent: Jun. 10, 2003

(54) METHOD OF REDUCING FINES IN A POWDERED PRODUCT AND FABRIC CLEANER PRODUCED THEREFROM

(75) Inventors: Thomas Mikic, Racine, WI (US); Heather R. Schramm, Whitewater, WI (US); Hans J. Weitkuhn, Racine, WI (US); Dolores T. Rodriguez, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/744,898

(22) PCT Filed: Jul. 28, 1999

(86) PCT No.: PCT/US99/16960

§ 371 (c)(1),
(2), (4) Date: Apr. 18, 2001

(87) PCT Pub. No.: WO00/06621

PCT Pub. Date: Feb. 10, 2000

Related U.S. Application Data

(60) Provisional application No. 60/094,847, filed on Jul. 31, 1999.

(51) Int. Cl.[7] ..... C11D 17/00

(52) U.S. Cl. ..... 510/278; 510/444; 510/445; 510/446; 510/276

(58) Field of Search ..... 510/444, 445, 510/446, 276, 278

(56) References Cited

U.S. PATENT DOCUMENTS

| | | | | | |
|---|---|---|---|---|---|
| 4,161,449 | A | * | 7/1979 | Smith et al. | 252/8.6 |
| 4,493,781 | A | | 1/1985 | Chapman et al. | |
| 4,552,777 | A | | 11/1985 | Dente et al. | |
| 4,566,980 | A | | 1/1986 | Smith | |
| 4,648,882 | A | * | 3/1987 | Osberghaus et al. | 8/142 |
| 4,666,940 | A | * | 5/1987 | Bischoff et al. | 514/544 |

FOREIGN PATENT DOCUMENTS

| | | | |
|---|---|---|---|
| EP | 0 618 287 A1 | | 10/1994 |
| GB | 2064575 | * | 6/1981 |
| GB | 2 064 575 A | | 6/1981 |
| GB | 2 109 399 A | | 6/1983 |

* cited by examiner

*Primary Examiner*—Charles Boyer

(57) ABSTRACT

A method that produces a powdered fabric cleaner is disclosed. The cleaner has a reduced level of fines. One introduces at least one particulate material and at least one liquid material into a mixing vessel to form a mixture, blends the mixture for a first period of time, chops the mixture for at least a portion of the first period of time, and thereafter blends the mixture without chopping for a second period of time. In one form the cleaning composition has at least 80% by weight of inorganic salt carrier particulates, 1–10% by weight of flow agent particulates, and 0.1–15% by weight of a liquid active material, such as a fragrance, a surfactant, a solvent, or a pesticide. At least 90.0% of the composition particulates have a particle size greater than 0.105 millimeters.

4 Claims, No Drawings

METHOD OF REDUCING FINES IN A POWDERED PRODUCT AND FABRIC CLEANER PRODUCED THEREFROM

CROSS REFERENCES TO RELATED APPLICATIONS

This application claims benefit from U.S. Provisional patent application No. 60/094,847, filed Jul. 31, 1998.

BACKGROUND OF THE INVENTION

1. Field of the Invention

The present invention relates to methods of reducing fines in powdered products, and more particularly to a method of reducing fines in powdered textile treating compositions, and powdered textile treating compositions prepared by the method.

2. Description of the Related Art

Household cleaning compositions are often supplied in a liquid or a powdered form. For example, carpet cleaning compositions have been widely available for some time in both liquid and powdered form. Liquid carpet cleaning compositions have typically been the first choice of many consumers. However, because of drawbacks in the liquid compositions, such as a tendency to cause shrinking, matting or wicking of carpet fibers, dry powdered carpet cleaning compositions have become quite popular. Examples of dry powdered carpet cleaning compositions can be found in U.S. Pat. Nos. 4,666,940, 4,552,777, 4,493,781, 4,395,347 and 4,161,449.

However, dry carpet cleaners and certain other powdered household products have a tendency to lose their free flowing properties during storage. For instance, powdered products may become compacted or "caked" due to settling and/or their tendency for absorbing moisture from the ambient air. Caked product is difficult to fill as well as dispense from containers. Therefore, flow agents (also known as anti-caking agents) are often added to powdered compositions in order to keep the powder free flowing.

Flow agents typically contain particles of small size and low density known as "fines" that can readily become airborne. Fines can be very irritating to nasal passages. In addition, a large number of fines in the ambient air can build up a static charge.

In consumer products such as a dry powdered carpet cleaner, fines may be difficult to vacuum. Also, the fines that are removed may not remain trapped inside a typical paper vacuum cleaner bag. As a result, a dust cloud of fines may developed during vacuuming that can be irritating to the nasal passages. In addition, the fines may leave an unsightly residue on shoes, clothing and surfaces in the home.

In the field of dry carpet cleaners, efforts at reducing fines have previously focussed on the incorporation of additional components into the cleaning formulation or the use of screening techniques. For instance, U.S. Pat. Nos. 4,161,449 and 4,552,777 disclose a conventional process for preparing a dry carpet cleaning composition from dry powdered components. These patents mention that a typical dry powdered carpet cleaning composition may include a dry powder inorganic salt carrier, a dry powder anti-caking agent, a liquid fragrance and a liquid dedusting agent. Typical inorganic salt carriers include sodium sulfate, sodium chloride, sodium carbonate, sodium bicarbonate, sodium borate, sodium citrate, sodium tripolyphosphate and sodium nitrate; suitable anti-caking agents include starch, silica powders, grain flours, wood flour, talc, pumice, clays, and calcium phosphates; conventional fragrances are liquid volatile odorous agents including essential oils and aromatic chemicals; and typical liquid dedusting agents may be alkyl phthalates, mineral oil, glycols, ethoxylated alcohols, alcohols, glycol ethers, vegetable oils, naphtha, mineral spirits and naphthalene sulfonates.

In preparing a dry carpet cleaning composition in according with the prior methods described in U.S. Pat. Nos. 4,161,449 and 4,552,777, (1) the dry powders, such as the carrier and the agglomerating agent, are dry blended in a first step, (2) the liquid components, such as the fragrance and any dedusting agent, are separately mixed together in a second step, (3) the mixtures prepared in steps (1) & (2) are admixed, and (4) if necessary, the final product is screened to remove undesirable lumps and fines.

Therefore, it is apparent that the methods described in these patents rely on liquid dedusting agents and screening to control fines in the final dry carpet cleaning product. These extra ingredients (i.e., dedusting agents) or process steps (i.e., screening) increase manufacturing costs, and in the case of screening, may call for measures to control the fines removed by screening.

Thus, further advances are desired to provide a solution to the problem of fines.

SUMMARY OF THE INVENTION

It is envisioned that improved methods of blending and agglomerating powdered products can be used to reduce fines in a final powdered product without the need for dedusting agents or screening techniques. Accordingly, these improved methods can be used to produce a particulate textile fiber or fabric cleaning composition that satisfies the need for a dry textile cleaning composition that has a minimal level of fines.

Agglomeration is the process of bringing together fine powders or particulates into larger masses with pressure, agitation and/or other mechanisms. Agglomerating techniques include: (1) pressure compacting, such as briquetting, tableting and using a pellet mill; (2) tumbling or granulation; and (3) spray congealing. In the context of dry powdered or particulate household cleaning chemicals, tumbling or granulation is typically the process of choice.

A method is disclosed for producing a particulate textile fiber or fabric cleaning composition that includes the steps of introducing at least one particulate material into a mixing vessel, introducing at least one liquid material into the mixing vessel to form a mixture, blending the mixture for a first time period, chopping the mixture for at least a portion of the first time period, and thereafter blending the mixture without chopping for a second time period. The method produces a particulate fabric cleaning composition having acceptable flow characteristics yet results in a reduced level of fines without the need for a screening step to remove fines. For the purposes of this patent, fabric includes natural and/or synthetic fiber products such as carpets, upholstery, drapes, and even clothing.

Without intending to be bound by theory, it is believed that chopping creates greater surface area (which is otherwise lessened by mixing liquid with solids) and that the greater area permits fine particles of the particulate materials (such as silica fines in a dry carpet cleaning composition) to become attached to the larger particles in the mix by agglomeration. Note that this is surprising as chopping might have been expected to increase dust/fines. Also, in the method of the present invention, the inclusion of a time period of blending and chopping the mixture serves to agglomerate particles and at the same time break up any large agglomerated particles that might clog the container. In other words, the blending serves to agglomerate smaller particles while the chopping serves to breakup larger oversized agglomerations. This helps to distribute any liquid materials and to create additional exposed sticky surfaces to which fines may attach. It is particularly desirable to reduce particles in the size range of 200 mesh (0.074 mm opening) and finer.

The chopping process is a high shear mixing that generally shears large agglomerated particles at the liquid interface between particles. However, individual particles may shear through the particule body. Therefore, as used herein, the term "chopping" refers to an action that can shear particle agglomerations at a liquid-solid interface or a solid-solid interface.

The step of introducing liquid material into the mixing vessel and the step of blending and chopping the mixture for a first period of time may all be performed simultaneously. Although the liquid material may be added to the mixing vessel in any manner, it is preferred that the liquid materials be introduced into the mixing vessel at a uniform flow rate, most preferably by a sprayer that provides a spray in order to produce a uniform powder.

As used herein, the term "acceptable flow characteristics" for a fabric cleaner means that the composition may be dispensed without clogging from conventional shaker-type containers that are widely used for packaging household cleaning compositions and have outlets of about 5 millimeters in diameter.

One version of a particulate textile fiber or fabric cleaning composition produced in accordance with the invention includes at least 80% by weight of inorganic salt carrier particulates, 1–10% by weight of flow agent particulates, and 0.1–15% by weight of a liquid active material selected from fragrances, surfactants, solvents, pesticides, and mixtures thereof. For example, the liquid may comprise 1–10% by weight of an acaricidal agent. Other standard fabric cleaner additives may also be included. At least 90% of the composition particulates have a particle size greater than 0.105 millimeters. The composition may be applied without dusting to natural or synthetic textile fibers or fabric and removed by vacuuming.

Accordingly, it is an object of the present invention to provide a method for preparing a dry particulate fabric cleaning composition that has a level of fines lower than dry particulate fabric cleaning compositions typically produced by conventional methods.

It is another object of the present invention to provide a method of reducing the fines in a particulate fabric cleaning composition produced by agglomeration techniques without the need for dedusting agents or screening techniques.

It is yet another object of the present invention to provide a method for preparing a dry fabric cleaning composition that reduces the amount of fines that can become airborne during manufacturing and use, and that maintains the desired flow, fragrancing and/or active delivery properties of the cleaning composition.

It is still another object of the present invention to provide a particulate fabric cleaning composition prepared from particulate and liquid materials that has a low level of fines that can become airborne during use, and that has the desired flow properties of a particulate textile fiber or fabric cleaning composition.

These and other objects and advantages of the present invention will be apparent from the description which follows. The description is merely of the preferred embodiments. To evaluate the full scope of the invention, the claims should be reviewed.

DETAILED DESCRIPTION OF THE INVENTION

The compositions of the invention are particularly and beneficially adapted for use in the cleansing of pile fabrics of the type knitted or woven principally into yarns or fibers. The compositions are believed most useful in the treatment of rugs and carpets. The formed textile fabric may be of vegetable, synthetic or animal origin, including mixtures thereof. Typically synthetic fabrics which may be beneficially treated by the present composition include viscose rayon, acetate rayon, polyamide, polyester polyolefin and acrylic. Other fibers of a vegetable or animal origin which can be treated include cotton, jute, ramie, wool and the like. The compositions of the present invention may also be designed for maintaining textile fabrics by including vacuuming aids.

In practice, the cleaning composition is applied to the surface, allowed to stand (e.g. a few minutes to a few hours) and thereafter removed by vacuuming or the like. The composition may be applied to the carpet by sprinkling from a shaker type container or through the use of any conventional particulate dispensing means.

The term "liquid active material" preferably designates a material that provides active properties to a particulate textile fiber or fabric cleaning composition. For example, the liquid active material used in the textile fiber or fabric cleaning composition may be a fragrance for odor control, a surfactant for cleaning, a solvent for cleaning, or a pesticide for pest control, such as an acaricide for control of mites and ticks.

The liquid active materials may be: (1) a fragrance, such as a liquid volatile odorous agent including essential oils and aromatic chemicals; (2) a solvent suitable for cleaning textile fibers, such as an ether alcohol (e.g., ethylene glycol monomethyl ether; (3) a surfactant or surfactant mixture suitable for cleaning textile fibers selected from any of the four basic groups of surface active agents including anionic (such as alkali metal salts of sulfate esters or sulfonates containing higher aliphatic hydrocarbon radicals of 8 or more carbon atoms), non-ionic (such as polyethylene oxide condensates of aliphatic alcohols having 8 or more carbon atoms), cationic (such as quaternary ammonium compounds), and amphoteric (such as tertiary amine oxide salts having a hydrophobic radical attached to the nitrogen atom); (4) an acaricide, such as benzyl benzoate; or (5) mixtures of any of the above listed liquid active materials.

In the particulate textile fiber or fabric cleaning composition of the present invention, suitable particulate carriers are inorganic salt carriers such as sodium sulfate, sodium chloride, sodium carbonate, sodium bicarbonate, sodium borate, sodium citrate, sodium tripolyphosphate, sodium nitrate and mixtures thereof. Suitable flow agents include silica, metal oxides such as alumina, and metal titanates.

One version of a particulate fabric cleaning composition made in accordance with the present invention includes at least 80% by weight of inorganic salt carrier particulates, 1–10% by weight of flow agent particulates, and 0.1–15% by weight of liquids selected from the group consisting of fragrances, surfactants, solvents, pesticides, and mixtures thereof, wherein at least 90% of the composition particulates have a particle size greater than 0.105 millimeters. A preferred version is as hereinafter set forth in claim 10.

One version of the method of the invention is a method for producing a fabric cleaning composition that includes the steps of introducing at least one particulate material into a mixing vessel, introducing at least one liquid material into the mixing vessel to form a mixture, blending the mixture for a first time period, chopping the mixture for at least a portion of the first time period, and thereafter blending the mixture without chopping for a second time period, wherein at least 90% of the resulting composition is particulates having a particle size greater than 0.105 millimeters.

An exemplary embodiment of the most preferred version of the composition is produced by: (1) adding 71 wt % sodium sulfate, 20 wt % sodium bicarbonate and 4 wt % hydrated amorphous silica to a ribbon blender having chopper blades; (2) adding a combination of 4.6 wt % liquid benzyl benzoate and 0.4 wt % liquid fragrance to the blender while mixing; (3) mixing with ribbons for a total of 2 minutes (or longer if needed to complete the transfer of liquid to the product); (4) mixing with ribbons and high speed chopper blades for 2.5 minutes; (5) turning off the chopper blades and continuing to mix with ribbons for 5.5 more minutes; (6) mixing with chopper blades and ribbons for 0.5 minutes; and (7) turning off the chopper blades and continuing to mix with ribbons for 5 minutes. In certain circumstances, mix times may be extended to accommodate raw materials with more fines.

If necessary, a mix and chop step may be run for 1 minute, and then a mix step may be run for two minutes. These extra steps may be repeated as needed. However, it is preferred that every mix and chop step be followed by a blending step without chopping so that any fines generated by the chopping process can be allowed to agglomerate in the further mixing step. It is should noted that this specific embodiment and the Examples that follow are illustrative in nature and should not be used to limit the scope of the invention.

The process can be facilitated by use of a paddle mixer equipped with high speed flat or tulip chopper blades or a ribbon blender equipped with high speed flat or tulip chopper blades. One suitable paddle-type mixer is a "Marion" brand paddle mixer equipped with a chopper, and is available from Marion Mixer Company, Marion, Iowa, USA. A suitable ribbon blender has a horizontal 'U' shaped container complete with agitator ribbons and chopper blades, and is available from American Process Systems, Gurnee, Ill., USA. The inner and outer ribbons operate in opposite directions to provide an even movement of material and effect a homogeneous blend.

The paddle mixer or ribbon blender motors should be sized appropriately for the density of the final dry carpet cleaning formulation. Suitable mixers or blenders include: (1) a 1.7 $m^3$ (60 cubic foot) capacity unit with a 75 horsepower main motor and four 20 horsepower chopper blades; and (2) a 2.83 $m^3$ (100 cubic foot) unit with a 100 horsepower main motor and four 20 horsepower chopper blades. All process equipment (including blender, chopping blades and filling equipment) are preferably clean and dry before starting the process, as water as may adversely affect the product.

Evaluation

The level of particle agglomeration was evaluated using a "Shake and Smoke" test and a sieve test. In the "Shake and Smoke" test, approximately 113.4 g, (4 ounces) of material were placed in an 226.8 g, (8 ounce) glass jar and the jar is sealed. The jar is then shaken vigorously by hand. The jar is opened immediately and observed to determine whether any dust particles rise out of the container (i.e., the material "smokes"). The "Shake and Smoke" test evaluates the dustiness of a product.

In the sieve test, particle size distributions are identified using standard-sized sieves. One suitable sieve tester is a CSC Scientific Sieve Shaker Catalog No. 18480. A typical sieve test involves loading 100 grams of sample into the sieve tester and using U.S. Standard Sieve sizes 20 (0.84 mm opening), 40 (0.42 mm), 60 (0.25 mm), 80 (0.177 min), 100 (0.149 mm), 120 (0.125 mm), 140 (0.105 mm), 170 (0.088 mm), 200 (0.074 mm), and 230 (0.062 mm) to separate the particles by size.

EXAMPLE 1

A dry carpet cleaning composition was prepared using the following ingredients:

| Ingredient | Weight kg (lbs.) | Wt. % |
|---|---|---|
| SODIUM SULFATE, ANHYDROUS (Carrier) | 96.6 (213.0) | 71.00 |
| SODIUM BICARBONATE, COARSE GRANULAR (Carrier) | 27.2 (60.0) | 20.00 |
| BENZYL BENZOATE (Acaricide) | 5.4 (12.0) | 4.60 |
| SILICA HYDRATED AMORPHOUS (Flow agent) | 6.3 (13.8) | 4.00 |
| FRAGRANCE (Fragrance RB 1807/A manufactured by Takasago International Corp.) | 0.54 (1.2) | 0.40 |
| | 136.04 (300.00) | 100.00 |

In preparing the dry carpet cleaning composition, the dry ingredients (sodium sulfate, sodium bicarbonate and silica) were added to a ribbon blander, such as the ribbon blender described above. The benzyl benzoate was inspected for visible evidence of crystallization, as it is preferred that the benzyl benzoate be completely liquid. If needed, the temperature of the benzyl benzoate may be raised to 75°±5° F. (23°±2° C.) to reverse any crystallization.

The liquid fragrance and the benzyl benzoate were then mixed together and poured over the dry ingredients in the ribbon blender. The ingredients were then mixed in the ribbon blender in the following sequence: (1) 2 minutes of ribbon blending; (2) 2.5 minutes of ribbon blending with chopper blades turned on; (3) 5.5 minutes of ribbon blending; (4) 0.5 minutes of ribbon blending with chopper blades turned on; and (5) 5 minutes of ribbon blending. The dry powdered carpet composition produced by this method was evaluated using the "Shake and Smoke" test described above, and no "smoking" was evident.

EXAMPLE 2

In an alternative, the sodium sulfate and sodium bicarbonate were charged to the ribbon blender and subjected to 4 minutes of ribbon blending. The liquid ingredients (benzyl benzoate and fragrance) were mixed together and applied to the sodium sulfate and sodium bicarbonate as a spray mist using a pressurized spray vessel with fine conical-style nozzles while all of the ingredients were subjected to 3 minutes of ribbon blending. The ingredients were then subjected to 1 minute of ribbon blending with chopper blades turned on. The silica was then added to the ribbon blender and the ingredients were subjected to 3 minutes of ribbon blending with chopper blades turned on. The ingredients in the ribbon blender were then subjected to 5 minutes of ribbon blending. A sample was obtained from the blender and it was discovered by visual inspection that adding the liquid ingredients through a spray device produced a more homogenous mixture than the mixture of Example 1.

EXAMPLE 3

A carpet cleaning composition was prepared using the ingredients listed in Example 1 and another method of blending and agglomerating the ingredients.

The dry ingredients (sodium sulfate, sodium bicarbonate and silica) were first added to the ribbon blender and then the liquid ingredients (benzyl benzoate and fragrance) were mixed together and sprayed over the dry ingredients in the ribbon blender while ribbon blending. The spray was a uniform, coarse spray from a planar fan-style nozzle. The ingredients were mixed in the ribbon blender in the following sequence: (1) 2 minutes of ribbon blending during application of the liquid spray; (2) 2.5 minutes of ribbon blending with chopper blades turned on; (3) 5.5 minutes of ribbon blending; (4) 0.5 minutes of ribbon blending with chopper blades turned on; and (5) 5 minutes of ribbon blending.

The dry powdered carpet composition produced by this method was evaluated using the "Shake and Smoke" test described above after 10, 10.5, 13.0 and 15.5 minutes of blending according to the blending sequence. The "Shake and Smoke" test produced the following results; (1) after 10 minutes of blending (which included 2.5 minutes of chopping beginning after two minutes), the "smoking" of the composition began to disappear; (2) after 10.5 minutes of blending, the "smoking" of the composition reappeared as a result of the chopping process; and (3) after 13 and 15.5 minutes of blending, the "smoking" of the composition had disappeared. Agglomeration of the powder was acceptable after 10 minutes.

This example shows that application of the liquid ingredients in a coarse spray, rather than a mist, decreases the level of fines much more significantly. In addition, the use of a process that includes the alternate steps of a blending for a first time period, chopping for a portion of the first time period, and thereafter blending for a second time period results in a carpet cleaning composition with a low level of fines as measured by the "Shake and Smoke" test.

EXAMPLE 4

A batch of dry carpet cleaner was prepared using the ingredients of Example 1 and the following sequence of steps. The dry ingredients (sodium sulfate, sodium bicarbonate and silica) were first added to the ribbon blender and then the liquid ingredients (benzyl benzoate and fragrance) were mixed together and sprayed over the dry ingredients in the ribbon blender while ribbon blending. The spray was a uniform, coarse spray from a planar fan-style nozzle.

The ingredients were mixed in the ribbon blender in the following sequence: (1) 2 minutes of ribbon blending during application of the liquid spray, which took 50 seconds at 103.4 kPa 15 psi); (2) 2.5 minutes of ribbon blending with chopper blades turned on; (3) 5.5 minutes of ribbon blending; (4) 0.5 minutes of ribbon blending with chopper blades turned on; and (5) 5 minutes of ribbon blending. Samples of the dry powdered carpet composition were taken from the blender after 10, 11, 11.5 and 15.5 minutes of blending according to the blending sequence. The samples were evaluated using the sieve test described above, i.e. 100 grams of each sample were placed into the sieve tester and separated by size using U.S. Standard Sieve sizes 20 (0.84 millimeter opening), 40 (0.42 mm, opening), 60 (0.25 mm.), 80 (0.177 mm.), 100 (0.149 mm.), 120 (0.125 mm.), 140 (0.105 mm.), 170 (0.088 mm.), 200 (0.074 mm.), and 230 (0.062 mm.). The results were as follows:

TABLE I

| Grams of Sample Retained by Sieve | | | | |
|---|---|---|---|---|
| US Standard | Blend/Chop Time (minutes) | | | |
| Sieve Size | 10 | 11 | 11.5 | 15.5 |
| 20 (0.84 mm) | 0.0 | 0.0 | 0.0 | 0.1 |
| 40 (0.42 mm) | 0.1 | 0.0 | 0.1 | 0.2 |
| 60 (0.25 mm) | 19.6 | 24.6 | 22.2 | 33.0 |
| 80 (0.177 mm) | 47.1 | 45.8 | 55.0 | 46.4 |
| 100 (0.149 mm) | 14.9 | 12.3 | 9.2 | 16.4 |
| 120 (0.125 mm) | 7.0 | 5.5 | 5.4 | 3.4 |
| 140 (0.105 mm) | 4.8 | 4.2 | 3.3 | 0.4 |
| 170 (0.088 mm) | 3.2 | 3.6 | 2.8 | 0.0 |
| 200 (0.074 mm) | 1.9 | 2.4 | 1.4 | 0.0 |
| 230 (0.062 mm) | 1.1 | 1.5 | 0.5 | 0.0 |
| Pan | 0.7 | 1.2 | 0.1 | 0.0 |

Looking at Table I, it can be seen that the level of fines (as defined by particles passing through the 170 sieve) varies depending on the stage of the blending/chopping process. For example: (1) after 10 minutes of blending/chopping according to the blending sequence (i.e., 2 minutes of ribbon blending, 2.5 minutes of ribbon blending with chopping, and 5.5 minutes of ribbon blending), 3.7 grams of the composition passed through the 170 sieve; (2) after 11 minutes of blending/chopping (i.e., 2 minutes of ribbon blending, 2.5 minutes of ribbon blending with chopping, 5.5 minutes of ribbon blending, 0.5 minutes of ribbon blending with chopping, and 0.5 minutes of ribbon blending), 5.1 grams of the composition passed through the 170 sieve; (3) after 11.5 minutes of blending/chopping (i.e., 2 minutes of ribbon blending, 2.5 minutes of ribbon blending with chopping, 5.5 minutes of ribbon blending, 0.5 minutes of ribbon blending with chopping, and 1 minute of ribbon blending), 2.0 grams of the composition passed through the 170 sieve; and (4) after 15.5 minutes of blending/chopping (i.e., 2 minutes of ribbon blending, 2.5 minutes of ribbon blending with chopping, 5.5 minutes of ribbon blending, 0.5 minutes of ribbon blending with chopping, and 5 minutes of ribbon blending), 0.0 grams of the composition passed through the 170 sieve.

Without intending to be bound by theory, the variation in the level of fines throughout the blending/chopping process can likely be explained as follows. After 10 minutes of blending/chopping according to the blending sequence, the method of the present invention produces a composition having an acceptable level of fines as demonstrated by the "Shake and Smoke" test performed in Example 3 above. The level of fines (as defined by particles passing through the 170 sieve) was 3.7% (3.7 grams for a 100 gram sample) after 10 minutes. In the first 10 minutes of the blending sequence, the ingredients are subjected to blending, blending with chopping, and blending.

After 11 minutes of blending/chopping according to the blending sequence, the level of fines (as defined by particles passing through the 170 sieve) rose to 5.1%. This indicates that the 0.5 minute period of blending and chopping after the first 10 minutes of blending and chopping serves to break up large agglomerations and free up fines. After 11.5 minutes of blending/chopping according to the blending sequence, the level of fines (as defined by particles passing through the 170 sieve) decreased to 2.0%. this indicates that the use of a blending/chopping step and a blending step after the initial 10 minutes of the blending/chopping sequence serves to further lower the level of fines in the composition. After 15.5 minutes of the blending/chopping sequence, the fines have been effectively eliminated.

The data in the above table also indicates that the carpet cleaning powder produced in the examples will be free flowing powders that are acceptable for dispensing in shaker-type containers used in the carpet cleaning field. In addition, the carpet cleaning powder will have reduced level of fines.

Referring to Table I, it can be seen that: after 10 minutes of blending/chopping according to the blending sequence, 93.5% of the particles have a particle size greater than 0.105 millimeters; after 11.5 minutes, 95.2% of the particles have a particle size greater than 0.105 millimeters, and 91.9% of the particles have a particle size greater than 0.125 millimeters; and after 15.5 minutes, 99.9% of the particles have a particle size greater than 0.105 millimeters, 99.5% of the particles have a particle size greater than 0.125 millimeters, and 96.1% of the particles have a particle size greater than 0.149 millimeters.

At each of these time periods, substantially all of the particles have a particle size less than 0.42 millimeters. The method produces a particulate carpet cleaning product having a low level of fines as measured by the sieve test, but at the same avoids producing a carpet cleaning product with larger agglomerations that hinder dispensing from shaker-type containers used in the field.

EXAMPLE 5

A batch of dry carpet cleaner was prepared using the ingredients of Example 1 and the following sequence of steps. The dry ingredients (sodium sulfate, sodium bicarbonate and silica) were first added to the ribbon blender and then the liquid ingredients (benzyl benzoate and fragrance) were mixed together and sprayed over the dry ingredients in the ribbon blender while ribbon blending. The spray was a coarse spray from a planar fan-style nozzle. The ingredients were mixed in the ribbon blender in the following sequence: (1) 2 minutes of ribbon blending during application of the liquid spray; (2) 3.5 minutes of ribbon blending with chopper blades turned on; and (3) 20.5 minutes of ribbon blending. Samples of the dry powdered carpet composition were taken from the blender after blending and evaluated using "Shake and Smoke" test described above. After blending, no "smoking" of the composition could be detected. This indicates that the use of another process that includes the alternate steps of a blending, a blending with chopping, and a blending results in a carpet cleaning composition with a low level of fines as measured by the "Shake and Smoke" test.

INDUSTRIAL APPLICABILITY

The method of the present invention may be readily utilized with currently known filling techniques and production equipment for granular or powdered treating compositions. In addition, carpet cleaning compositions produced by the present method may be applied to a carpet by sprinkling from a shaker type container or through the use of any conventional particulate dispensing means.

Other modifications and variations of the present invention will become apparent to those skilled in the art from an examination of the above specification. Therefore, other variations of the present invention may be made even though such variations were not specifically discussed above.

We claim:

1. A method for producing a fabric cleaning composition, comprising the steps of:

(a) introducing into a mixing vessel at least one particulate material comprising an inorganic salt carrier and a flow agent, wherein said inorganic salt carrier is selected from the group consisting of sodium sulfate, sodium chloride, sodium carbonate, sodium bicarbonate, sodium borate, sodium citrate, sodium tripolyphosphate, sodium nitrate and mixtures thereof; and said flow agent is selected from the group consisting of silica and metal oxides;

(b) introducing at least one liquid active material, selected from the group consisting of fragrances, surfactants, solvents, pesticides, and mixtures thereof, into the mixing vessel to form a mixture;

(c) blending the mixture for a first predetermined period of time;

(d) chopping the mixture for at least a portion of the first predetermined period of time; and (e) thereafter blending the mixture without chopping for a second predetermined period of time, so as to agglomerate any fins produced during said chopping, whereby at least 95% of the resulting composition comprises particulates having a particle size greater than 0.105 millimeters and the composition comprises at least 80 weight percent inorganic salt carrier, from 1 to 10 weight percent flow agent, and from 0.1 to 15 weight percent liquid active agent.

2. The method of claim 1 wherein:

the composition is formed without a screening step, steps (b) and (c) are performed simultaneously, said liquid active material is introduced into the mixing vessel by a sprayer, said mixing vessel is selected from the group consisting of a ribbon blender with chopper blades and a paddle mixer with chopper blades; and at least 99% of the resulting composition is particulates having a particle size greater than 0.105 millimeters.

3. The method of claim 2, wherein said liquid active agent comprises benzyl benzoate.

4. A powdered carpet cleaner comprising:

at least 80% by weight of inorganic salt carrier particulates selected from the group consisting of sodium sulfate, sodium chloride, sodium carbonate, sodium bicarbonate, sodium borate, sodium citrate, sodium tripolyphosphate, sodium nitrate and mixtures thereof;

1–10% by weight of silica;

1–10% by weight of benzyl benzoate; and 0.1–5% by weight of a fragrance, wherein at least 90% of the composition particulates have a particle size greater than 0.105 millimeters and less than 0.42 millimeters; and wherein said cleaner has been produced by the steps of (a) introducing at least one particulate material into a mixing vessel;

(b) introducing at least one liquid active material, selected from the group consisting of fragrances, surfactants, solvents, pesticides, and mixtures thereof, into the mixing vessel to form a mixture;

(c) blending the mixture for a first predetermined period of time;

(d) chopping the mixture for at least a portion of the first predetermined period of time; and (e) thereafter blending the mixture without chopping for a second predetermined period of time, so as to agglomerate any fines produced during said chopping.

* * * * *

UNITED STATES PATENT AND TRADEMARK OFFICE

CERTIFICATE OF CORRECTION

PATENT NO. : 6,576,601 B1
DATED : June 10, 2003
INVENTOR(S) : Thomas Mikic et al.

It is certified that error appears in the above-identified patent and that said Letters Patent is hereby corrected as shown below:

Column 10,
Line 23, replace “fins” with -- fines --

Signed and Sealed this

Eighteenth Day of May, 2004

JON W. DUDAS
*Acting Director of the United States Patent and Trademark Office*